United States Patent [19]

Inoue et al.

[11] Patent Number: 4,935,201

[45] Date of Patent: Jun. 19, 1990

[54] FERROMAGNETIC NI-FE ALLOY, AND METHOD FOR MANUFACTURING ALLOY ARTICLE HAVING EXCELLENT SURFACE QUALITY OF SAID ALLOY

[75] Inventors: Tadashi Inoue; Tomoyoshi Okita, both of Tokyo, Japan

[73] Assignee: NKK Corporation, Tokyo, Japan

[21] Appl. No.: 345,350

[22] Filed: Apr. 28, 1989

[30] Foreign Application Priority Data

May 13, 1988 [JP] Japan ..... 63-116549

[51] Int. Cl.[5] ..... C22C 19/03

[52] U.S. Cl. ..... 420/458; 148/11.5 N; 420/459

[58] Field of Search ..... 420/453, 458, 459; 148/11.5 N, 426

[56] References Cited

FOREIGN PATENT DOCUMENTS 60-7017 2/1985 Japan .
62-227053 10/1987 Japan .
62-227054 10/1987 Japan .

*Primary Examiner*—R. Dean

*Attorney, Agent, or Firm*—Frishauf, Holtz, Goodman & Woodward

[57] ABSTRACT

A ferromagnetic Ni-Fe alloy consisting essentially of:

| | |
|---|---|
| nickel | from 75 to 82 wt. %, |
| molybdenum | from 2 to 6 wt. %, |
| boron | from 0.001 to 0.005 wt. %, |
| calcium | within the range satisfying any one of the following formulae in a weight ratio to sulfur as an incidental impurity, depending upon an oxygen content as an incidental impurity: $1.5 \leqq Ca/S \leqq 3.5$, or $1.15 \leqq Ca/S \leqq 3.50$, |

and the balance being iron and incidental impurities. Said alloy may further additionally contain from 1 to 5 wt. % copper and/or from 0.1 to 0.4 wt. % manganese. An alloy article such as a slab or a strip having an excellent surface quality of said alloy is manufactured by heating a material having the above-mentioned chemical composition to a temperature of from 1,100° to 1,250° C., and then hot-working the thus heated material at a finishing temperature of at least 800° C.

14 Claims, 3 Drawing Sheets

FERROMAGNETIC NI-FE ALLOY, AND METHOD FOR MANUFACTURING ALLOY ARTICLE HAVING EXCELLENT SURFACE QUALITY OF SAID ALLOY

As far as we know, there are available the following prior art documents pertinent to the present invention:

(1) Japanese Patent Publication No. 60-7,017 dated Feb. 21, 1985;

(2) Japanese Patent Provisional Publication No. 62-227,053 dated Oct. 6, 1987; and (3) Japanese Patent Provisional Publication No. 62-227,054 dated Oct. 6, 1987.

The contents of the prior arts disclosed in the above-mentioned prior art documents will be discussed hereafter under the heading of the "BACKGROUND OF THE INVENTION."

FIELD OF THE INVENTION

The present invention relates to a ferromagnetic Ni-Fe alloy and a method for manufacturing an alloy article such as a slab or a strip having an excellent surface quality of said alloy.

BACKGROUND OF THE INVENTION

An Ni-Fe alloy corresponding to PC specified in JIS (abbreviation of Japanese Industrial Standards) (hereinafter referred to as "PC permalloy") is a magnetic material widely applied for a case and a core of a magnetic head, cores of various transformers, and various magnetic sealing materials.

An ingot of the above-mentioned PC permalloy is poor in hot-workability. When the ingot of PC permalloy is slabbed, therefore, many surface flaws are produced on the resultant slab for reasons as described later.

Hot-workability of the ingot of PC permalloy varies depending upon the nickel content in the ingot. More specifically, a higher nickel content in the ingot of PC permalloy leads to a lower hot-workability of the ingot. As a result, an ingot of PC permalloy containing nickel in an amount of about 80 wt. % is far inferior in hot-workability to an ingot of an Ni-Fe alloy containing nickel in an amount of about 35 to 45 wt. %. When manufacturing a slab having a few surface flaws such as edge cracks, i.e., having an excellent surface quality, from an ingot of PC permalloy, therefore, the slabbing process could not be adopted, so that it was inevitable to adopt the forging process. The reasons are as follows: A multi-axial stress and a shearing stress mainly act on the ingot in the slabbing process, whereas a compression stress mainly acts on the ingot in the forging process. However, the forging process has a lower hot-working efficiency than in the slabbing process, and the production of surface flaws on the slab cannot largely be reduced even by adopting the forging process. It is therefore necessary to remove surface flaws on the slab even in the forging process, and this requires additional time and labor for manufacturing a slab.

When a slab is manufactured by slabbing an ingot in general or when a strip is manufactured by hot-rolling the thus prepared slab, not limited to an ingot of PC permalloy, having a poor hot-workability, many surface flaws such as edge cracks are produced on the thus manufactured slab or strip. The reason is as follows: When the ingot is slabbed or when the slab is hot-rolled, the ingot or the slab deforms at a strain rate of at least $1S^{-1}$. The edge portion and the surface layer portion of the ingot or the slab at this stage have a temperature of about 800° C. lower than that at the center portion of the ingot or the slab. If the ingot or the slab having such a temperature difference is subjected to the deformation by the slabbing or the hot-rolling, therefore, surface flaws such as edge cracks are produced on the resultant slab or strip.

Particularly when the ingot of PC permalloy poor in hot-workability is subjected to the slabbing, numerous surface flaws are produced on the resultant slab. The reason is as follows: When the ingot of PC permalloy is slabbed, impurity elements segregate on the grain boundaries of austenite during the temperature decrease of the ingot, thus making the grain boundaries more brittle. As a result, ductility of the ingot is seriously deteriorated at an ingot temperature of from 800° to 1,000° C. This causes production of numerous surface flaws on the slab.

The above-mentioned problem is posed also when manufacturing an alloy sheet through hot-rolling of the slab or when manufacturing a press-formed article by hot-pressing the thus rolled alloy sheet.

As Ni-Fe alloys to solve these problems, the following ferromagnetic ones have been proposed.

(1) A ferromagnetic Ni-Fe alloy disclosed in Japanese Patent Publication No. 60-7,017 dated Feb. 21, 1985, which consists essentially of:

| | |
|---|---|
| nickel | from 75.0 to 84.9 wt. %, |
| titanium | from 0.5 to 5.0 wt. %, |
| magnesium | from 0.0010 to 0.0020 wt. %, |

and the balance being iron and incidental impurities, where, the respective contents of carbon and sulfur as said incidental impurities being:

up to 0.03 wt. % for carbon, and up to 0.003 wt. % for sulfur.

(hereinafter referred to as the "prior art 1").

(2) A ferromagnetic Ni-Fe alloy disclosed in Japanese Patent Provisional Publication No. 62-227,053 dated Oct. 6, 1987, which consists essentially of:

| | |
|---|---|
| nickel | from 70 to 85 wt. %, |
| manganese | from 1.2 to 10.0 wt. %, |
| molybdenum | from 1.0 to 6.0 wt. %, |
| copper | from 1.0 to 6.0 wt. %, |
| chromium | from 1.0 to 5.0 wt. %, |
| boron | from 0.0020 to 0.0150 wt. %, |

and the balance being iron and incidental impurities, where, the respective contents of sulfur, phosphorus and carbon as said incidental impurities being:

up to 0.005 wt. % for sulfur, up to 0.01 wt. % for phosphorus, and up to 0.01 wt. % for carbon.

(hereinafter referred to as the "prior art 2").

(3) A ferromagnetic Ni-Fe alloy disclosed in Japanese Patent Provisional Publication No. 62-227,054 dated Oct. 6, 1987, which consists essentially of:

| | |
|---|---|
| nickel | from 70 to 85 wt. %, |
| manganese | up to 1.2 wt. %, |
| molybdenum | from 1.0 to 6.0 wt. %, |
| copper | from 1.0 to 6.0 wt. %, |
| chromium | from 1.0 to 5.0 wt. %, |

-continued

| | |
|---|---|
| boron | from 0.0020 to 0.0150 wt. %, |

and the balance being iron and incidental impurities, where, the respective contents of sulfur, phosphorus and carbon as said incidental impurities being:

up to 0.005 wt. % for sulfur,
up to 0.01 wt. % for phosphorus, and
up to 0.01 wt. % for carbon.

and the weight ratio of the boron content to the total content of sulfur, phosphorus and carbon as said incidental impurities being within the range of from 0.08 to 7.0.

(hereinafter referred to as the "prior art 3").

The above-mentioned prior art 1 involves the following problems: The prior art 1 is characterized in that hot-workability of the alloy is improved by fixing sulfur which is one of the impurity elements by means of magnesium which has a strong tendency to form a sulfide. However, the value of reduction of area at a temperature within the range of from 800° to 1,000° C., which is particularly important for the hot-working, is as low as from 40 to 60%, as disclosed in the example of the prior art 1. As a result, application of the hot-working to the alloy material of the prior art 1 causes production of many surface flaws on the obtained slab.

The above-mentioned prior arts 2 and 3 involve the following problems: The prior arts 2 and 3 are characterized in that hot-workability of the alloy is improved by reducing the contents of sulfur, phosphorus and carbon which are the impurity elements, and adding boron to inhibit segregation of the impurity elements on the grain boundaries of austenite. However, the alloys of the prior arts 2 and 3 have a very low hot-workability as described below. The alloy No. 2 disclosed in the example of the prior art 2 was melted in a vacuum melting furnace, and then cast into an ingot. Then, a test piece having a diameter of 5 mm and a length of 100 mm was cut from the thus cast ingot. The test piece was heated to a temperature of 1,200° C. and then cooled to a temperature of 900° C. On the thus hated and cooled test piece, a value of reduction of area was measured. The test piece showed a value of reduction of area of 20%.

The value of reduction of area is defined as follows: Assume that a tensile stress is applied in a tension test to a test piece at a strain rate of at least $1S^{-1}$ until the test piece is fractured. The value of reduction of area means a percentage ((A-A')/Ax100) of the difference (A-A') between the original sectional area (A) of the test piece and the minimum sectional area (A') thereof upon the fracture, relative to the original sectional area (A) thereof. The same applies also hereafter to the term "value of reduction of area" in all cases.

A test piece was cut from the alloy No. 5 disclosed in the example of the prior art 3 in the same manner as in the above-mentioned prior art 2, and a value of reduction of area for this test piece was measured under the same conditions as in the prior art 2. The test piece showed a value of reduction of area of 25%.

In both the prior arts 2 and 3, the value of reduction of area at 900° C., which is particularly important in the hot-working, is low as described above. As a result, application of the hot-working to the alloy materials of the prior arts 2 and 3 causes production of many surface flaws on the obtained slabs.

Under such circumstances, there is a strong demand for the development of a ferromagnetic Ni-Fe alloy having an excellent hot-workability as represented by a value of reduction of area of over 60% at a temperature within the range of from 800° to 1,000° C. and a method for manufacturing a slab having an excellent surface quality of such an alloy, but such an alloy and a method for manufacturing such a slab of the alloy have not as yet been proposed.

SUMMARY OF THE INVENTION

An object of the present invention is therefore to provide a ferromagnetic Ni-Fe alloy having an excellent hot-workability as represented by a value of reduction of area of over 60% at a temperature within the range of from 800° to 1,000° C., and a method for manufacturing an alloy article such as a slab or a strip having an excellent surface quality of said alloy.

In accordance with one of the features of the present invention, there is provided a ferromagnetic Ni-Fe alloy consisting essentially of:

| | |
|---|---|
| nickel | from 75 to 82 wt. %, |
| molybdenum | from 2 to 6 wt. % |
| boron | from 0.001 to 0.005 wt. %, |
| calcium | within the range satisfying |

the following formula in a weight ratio to sulfur as an incidental impurity, in the case of an oxygen content as an incidental impurity being within the range of from over 0.001 to 0.003 wt. %:

$$1.5 \leqq Ca/S \leqq 3.5 \ldots \quad (1),$$

or within the range satisfying the following formula in a weight ratio to sulfur as an incidental impurity, in the case of an oxygen content as an incidental impurity being up to 0.001 wt. %:

$$1.15 \leqq Ca/S \leqq 3.50 \ldots \quad (2),$$

and the balance being iron and incidental impurities, where, the respective contents of sulfur, phosphorus, carbon, oxygen and nitrogen as said incidental impurities being:

up to 0.002 wt. % for sulfur,
up to 0.006 wt. % for phosphorus,
up to 0.003 wt. % for carbon,
up to 0.003 wt. % for oxygen, and
up to 0.0015 wt. % for nitrogen.

Said ferromagnetic Ni-Fe alloy may further additionally contain copper in an amount within the range of from 1 to 5 wt. % and/or manganese in an amount of within the range of 0.1 to 0.4 wt. %.

In accordance with another feature of the present invention, there is provided a method for manufacturing an alloy article having an excellent surface quality of a ferromagnetic Ni-Fe alloy, characterized by comprising the steps of:

using a material consisting essentially of:

| | |
|---|---|
| nickel | from 75 to 82 wt. %, |
| molybdenum | from 2 to 6 wt. %, |
| boron | from 0.001 to 0.005 wt. %, |
| calcium | within the range satisfying |

the following formula in a weight ratio to sulfur as an incidental impurity, in the case of an oxygen content as an incidental impurity being within the range of from over 0.001 to 0.003 wt. %:

$$1.5 \leqq Ca/S \leqq 3.5 \ldots \quad (1),$$

or within the range satisfying the following formula in a weight ratio to sulfur as an incidental impurity, in the case of an oxygen content as an incidental impurity being up to 0.001 wt. %:

$$1.15 \leqq Ca/S \leqq 3.50 \ldots \quad (2),$$

and the balance being iron and incidental impurities, where, the respective contents of sulfur, phosphorus, carbon, oxygen and nitrogen as said incidental impurities being:

up to 0.002 wt. % for sulfur,
up to 0.006 wt. % for phosphorus,
up to 0.003 wt. % for carbon,
up to 0.003 wt. % for oxygen, and
up to 0.0015 wt. % for nitrogen.

heating said material to a temperature within the range of from 1,100° to 1,250° C., and then hot-working said material thus heated at a finishing temperature of at least 800° C. to manufacture an alloy article having an excellent surface quality of a ferromagnetic Ni-Fe alloy.

Said material may further additionally contain copper in an amount within the range of from 1 to 5 wt. % and/or manganese in an amount within the range of from 0.1 to 0.4 wt. %.

DETAILED DESCRIPTION OF PREFERRED EMBODIMENTS

Figure 1:
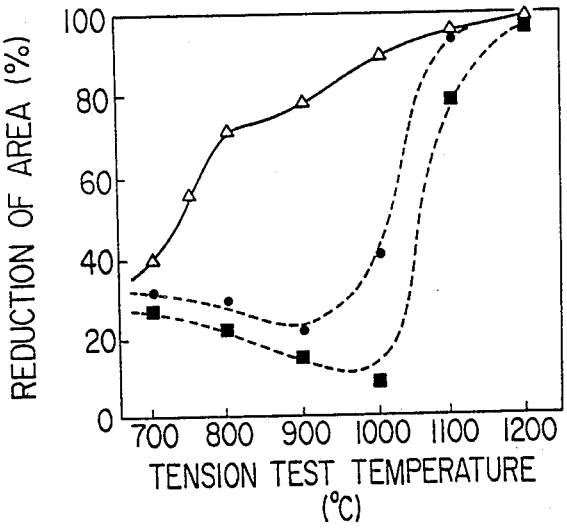
FIG. 1 is a graph illustrating the relationship between the value of reduction of area and the tension test temperature for Ni-Fe alloy materials having different boron contents.

From the above-mentioned point of view, extensive studies were carried out to develop a ferromagnetic Ni-Fe alloy having a more excellent hot-workability than those of the prior arts 1 to 3, and a method for manufacturing a slab having an excellent surface quality of such an alloy. As a result, the following finding was obtained: It is possible to obtain a ferromagnetic Ni-Fe alloy having a remarkably excellent hot-workability, by keeping the weight ratio of calcium to sulfur as an incidental impurity within a prescribed range, adding boron in a prescribed amount, and reducing the respective contents of sulfur, phosphorus, carbon and nitrogen as incidental impurities to below a certain amount.

Furthermore, the following finding was obtained: It is possible to reduce the calcium content in the Ni-Fe alloy, which adversely affects magnetic property of the alloy, without deteriorating hot-workability of the alloy, by reducing the content of oxygen as an incidental impurity to below a certain amount.

Moreover, the following finding was obtained: It is possible to manufacture a slab having an excellent surface quality of a ferromagnetic Ni-Fe alloy by heating the above-mentioned alloy material to a temperature within the range of from 1,100° to 1,250° C., and then, hot-working the thus heated material at a finishing temperature of at least 800° C.

The present invention was made on the basis of the above-mentioned findings, and the ferromagnetic Ni-Fe alloy of the present invention has a chemical composition comprising:

| | |
|---|---|
| nickel | from 75 to 82 wt. %, |
| molybdenum | from 2 to 6 wt. %, |
| boron | from 0.001 to 0.005 wt. %, |
| calcium | within the range satisfying |

the following formula in a weight ratio to sulfur as an incidental impurity, in the case of an oxygen content as an incidental impurity being within the range of from over 0.001 to 0.003 wt. %:

$$1.5 \leqq Ca/S \leqq 3.5 \ldots \quad (1),$$

or within the range satisfying the following formula in a weight ratio to sulfur as an incidental impurity, in the case of an oxygen content as an incidental impurity being up to 0.001 wt. %:

$$1.15 \leqq Ca/S \leqq 3.50 \ldots \quad (2),$$

and the balance being iron and incidental impurities, where, the respective contents of sulfur, phosphorus, carbon, oxygen and nitrogen as said incidental impurities being:

up to 0.002 wt. % for sulfur,
up to 0.006 wt. % for phosphorus,
up to 0.003 wt. % for carbon,
up to 0.003 wt. % for oxygen, and up to 0.0015 wt. % for nitrogen.

The ferromagnetic Ni-Fe alloy of the present invention may further additionally contain copper in an amount within the range of from 1 to 5 wt. % and/or manganese in an amount within the range of from 0.1 to 0.4 wt. %.

The chemical composition of the ferromagnetic Ni-Fe alloy of the present invention is limited within the ranges as described above for the following reasons:

(1) Nickel:

Nickel is an element having an important effect on a magnetic permeability of the alloy. However, a nickel content of under 75 wt. % leads to a lower magnetic permeability. A nickel content of over 82 wt. % leads, on the other hand, also to a lower magnetic permeability. The nickel content should therefore be limited within the range of from 75 to 82 wt. %.

(2) Molybdenum:

Molybdenum has the function of inhibiting the growth of $Ni_3Fe$ superlattice in an Ni-Fe alloy, and thus improving a magentic permeability of the alloy. However, with a molybdenum content of under 2 wt. %, a desired effect as described above cannot be obtained. A molybdenum content of over 6 wt. %, on the other hand, leads also to a lower magnetic permeability. The molybdenum content should therefore be limited within the range of from 2 to 6 wt. %.

(3) Boron:

Boron has the function of inhibiting segregation on the grain boundaries of phosphorus, one of incidental impurities in the alloy, and of segregation on the grain boundaries of sulfur, also one of the incidental impurities in the alloy, which could not be fixed by calcium as described later, and thus improving hot-workabilioty of the alloy. With a boron content of under 0.001 wt. %, however, a desired effect as mentioned above cannot be obtained. A boron content of over 0.005 wt. % causes, on the other hand, formation of the intermetallic compounds of boron, leading to a grain boundary brittleness, and hence to a lower hot-workability of the alloy. The boron content should therefore be limited within the range of from 0.001 to 0.005 wt. %.

For the purpose of investigating the effect of addition of boron, the following test was carried out: The alloy of the present invention No. 7 and the alloys for comparison Nos. 18 and 20 as shown in Table 1 presented later were melted in a vacuum melting furnace, and then cast into ingots. Then, test pieces having a diameter of 5 mm and a length of 100 mm were cut from the thus cast ingots. These test pieces were then heated to a temperature of 1,200° C. Subsequently, these test pieces were cooled to different tension test temperatures, to measure values of reduction of area at the respective tension test temperatures. The result is shown in FIG. 1. In FIG. 1, the mark "Δ" represents the test piece of the alloy of the present invention No. 7; the mark " ● " represents the test piece of the alloy for comparison No. 18 having the contents of calcium, sulfur and phosphorus within the scope of the present invention, but not added with boron; and the mark " ■ " represents the test piece of the alloy for comparison No. 20 having the contents of calcium, sulfur and phosphorus within the scope of the present invention but having a higher boron content outside the scope of the present invention.

As is clear from FIG. 1, the values of reduction of area for the test pieces of the alloy of the present invention No. 7 are higher than those for the rest pieces of the alloys for comparison Nos. 18 and 20, and are considerably high within the temperature range of from 800° to 1,000° C. which is particularly important for the hot-working. This suggests that the test pieces of the alloy of the present invention No. 7 are excellent in hot-workability, and hence that, in order to improve hot-workability of the alloy, it is necessary to add boron in a prescribed amount.

Then the following test was carried out to investigate the optimum range of boron content: The alloy for comparison No. 18 as shown in Table 1 presented later was melted in a vacuum melting furnace while adding boron, and then cast into ingots. Then, test pieces having a diameter of 5 mm and a length of 100 mm were cut from the thus cast ingots. These test pieces were then heated to a temperature of 1,200° C. Subsequently, these test pieces were cooled to a temperature within the range of from 800° to 1,000° C., to measure the minimum values of reduction of area of these test pieces within this temperature range. The result is shown in FIG. 2.

Figure 2:
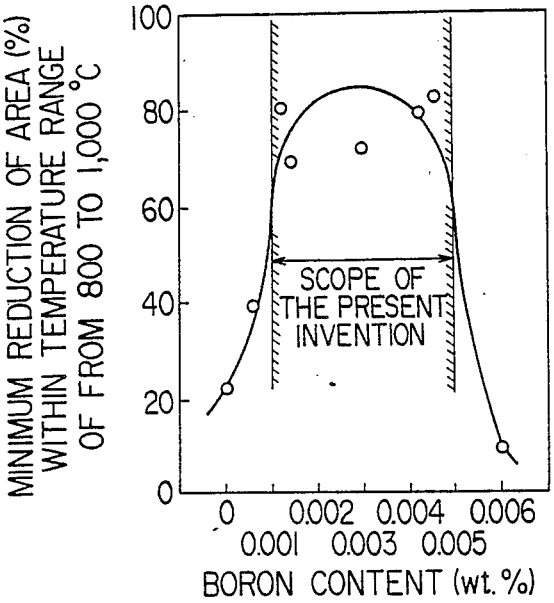
FIG. 2 is a graph illustrating the relationship between the boron content and the minimum value of reduction of area within the tension test temperature range of from 800° to 1,000° C. for an Ni-Fe alloy material.

As is clear from FIG. 2, within the range of the boron content of from 0.001 to 0.005 wt. %, the minimum value of reduction of area is over 60% which is the target in the present invention.

(4) Calcium:

Calcium has the function of improving hotworkability of the alloy by fixing sulfur which is one of incidental impurities and segregates on the grain boundaries upon solidification of the alloy. However, with a weight ratio of calcium to sulfur of under 1.5, a desired effect as described above cannot be obtained since sulfur is not sufficiently fixed by calcium. With a weight ratio of calcium to sulfur of over 3.5, on the other hand, low-melting-point intermetallic compounds are formed by the presence of excessive calcium, leading to a grain boundary brittleness, and resulting in a lower hot-workability of the alloy. The weight ratio of clacium to sulfur should therefore be limited within the range of from 1.5 to 3.5.

Figure 3:
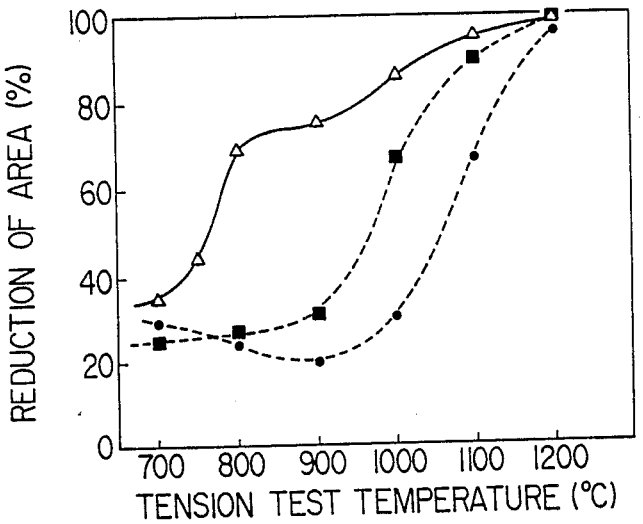
FIG. 3 is a graph illustrating the relationship between the value of reduction of area and the tension test temperature for Ni-Fe alloy materials having different weight ratios of calcium to sulfur.
Figure 4:
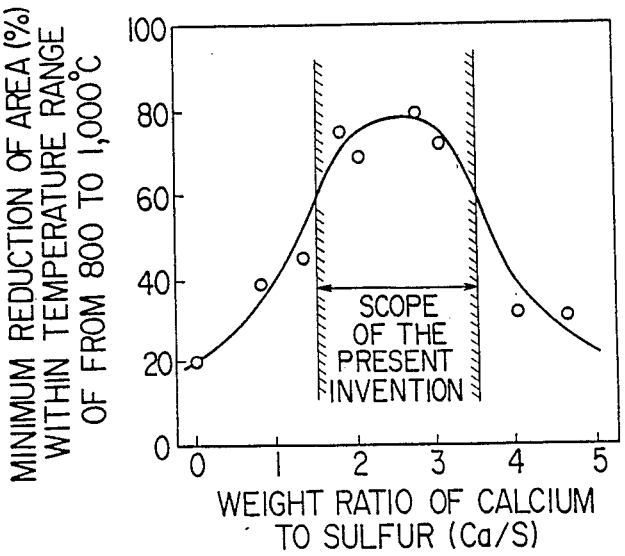
FIG. 4 is a graph illustrating the relationship between the weight ratio of calcium to sulfur and the minimum value of reduction of area within the tension test temperature range of from 800° to 1,000° C. for an Ni-Fe alloy material having an oxygen content of over 0.001 wt. %.

The following test was carried out to investigate the effect of addition of calcium: The alloy of the present invention No. 5 and the alloys for comparison Nos. 15 and 17 as shown in Table 1 presented later were melted in a vacuum melting furnace, and then cast into ingots. Then test pieces having a diameter of 5 mm and a length of 100 mm were cut from the thus cast ingots. These test pieces were then heated to a temperature of 1,200° C. Subsequently, these test pieces were cooled to different tension test temperatures, to measure values of reduction of area at the respective tension test temperatures. The result is shown in FIG. 3. In FIG. 4, the mark "Δ" represents the test piece of the alloy of the present invention No. 5 having a weight ratio of calcium to sulfur of 2.0; the mark " ● " represents the test piece of the alloy for comparison No. 15 not added with calcium, i.e., having a weight ratio of calcium to sulfur of zero; and the mark " ■ " represents the test piece of the alloy for comparison No. 17 having a weight ratio of calcium to sulfur of 4.6.

As is clear from FIG. 3, the values of reduction of area for the test pieces of the alloy of the present invention No. 5 are higher than those for the test pieces of the alloys for comparison Nos. 15 and 17, and are considerably high within the temperature range of from 800° to 1,000° C. which is particularly important for the hot-working. This suggests that the test pieces of the alloy of the present invention No. 5 are excellent in hot-workability, and hence that, in order to improve hot-workability of the alloy, it is necessary to add calcium so that the weight ratio thereof to sulfur becomes a prescribed value.

Then, the following test was carried out to investigate the optimum weight ratio of calcium to sulfur: The alloy of the present invention No. 5 as shown in Table 1 presented later was melted in a vacuum melting furnace while changing the calcium content thereof, and then cast into ingots. Then, test pieces having a diameter of 5 mm and a length of 100 mm were cut from the thus cast ingots. These test pieces were then heated to a temperature of 1,200° C. Subsequently, these test pieces were cooled to a temperature within the range of from 800° to 1,000° C., to measure the minimum values of reduction of area of these test pieces within this temperature range. The result is shown in FIG. 4.

As is clear from FIG. 4, the minimum value of reduction of area is over 60% which is the target in the present invention, with a weight ratio of calcium to sulfur within the range of from 1.5 to 3.5.

Then, the effect of oxygen as one of incidental impurities contained in an alloy on the weight ratio of calcium to sulfur was investigated. More specifically, the relationship between the minimum value of reduction of area within the temperature range of from 800° to 1,000° C., on the one hand, and the weight ratio of calcium to sulfur, on the other hand, was investigated under the same test conditions as described above with reference to FIG. 4, for the test pieces of the alloy having the same chemical composition as that of the alloy described above with reference to FIG. 4 except that the oxygen content in the alloy was set up to 0.001 wt. %. The result is shown in FIG. 5.

Figure 5:
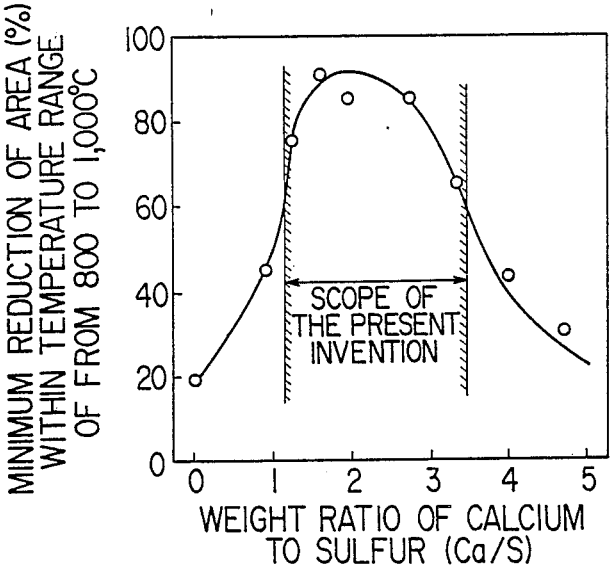
FIG. 5 is a graph illustrating the relationship between the weight ratio of calcium to sulfur and the minimum value of reduction of area within the tension test temperature range of from 800° to 1,000° C. for an Ni-Fe alloy material having an oxygen content of up to 0.001 wt. %.

As is clear from FIG. 5, the minimum value of reduction of area is over 60% which is the target in the present invention, with a weight ratio of calcium to sulfur within the range of from 1.15 to 3.50, in the case of the oxygen content in the alloy of up to 0.001 wt. %. Also as is evident from FIG. 5, with an oxygen content in the alloy of up to 0.001 wt., the lower limit of the weight ratio of calcium to sulfur to achieve the target value of reduction of area of the present invention becomes smaller. More particularly, the amount of added calcium which adversely affects the magnetic property of the alloy can be reduced within the limits not deteriorating hot-workability of the alloy by reducing the oxygen content in the alloy to up to 0.001 wt. %. With an oxygen content in the alloy of up to 0.001 wt. %, therefore, the weight ratio of calcium to sulfur should be limited within the range of from 1.15 to 3.50.

(5) Copper:

Copper has the function, like molybdenum described above, of improving a magnetic permeability of the alloy. In the present invention, therefore, copper is additionally added as required. With a copper content of under 1 wt. %, however, a desired effect as described above cannot be obtained. A copper content of over 5 wt. % leads, on the other hand, to a lower magnetic permeability. The copper content should therefore be limited within the range of from 1 to 5 wt. %.

(6) Manganese:

Manganese has the function of improving a hot-workability of the alloy. In the present invention, therefore, manganese is additionally added as required. With a manganese content of under 0.1 wt. %, however, a desired effect as described above cannot be obtained, and sulfur which is one of the incidental impurities, cannot be fixed. With a manganese content of over 0.4 wt. %, on the other hand, strength of the matrix of the alloy becomes excessively high, and resulting in an easy occurrence of the grain boundary fracture and a lower hotworkability. Therefore, the manganese content should be limited within the range of from 0.1 to 0.4 wt. %.

(7) Sulfur:

sulfur is one of impurities inevitably entrapped into the alloy. Although the sulfur content should preferably be the lowest possible, it is difficult to largely reduce the sulfur content in an industrial scale from the economic point of view. With a sulfur content of over 0.002 wt. %, however, hot-workability of the alloy is not improved even by adding calcium and boron. The sulfur content should therefore be limited to up to 0.002 wt. %.

(8) Phosphorus:

Phosphorus is one of impurities inevitably entrapped into the alloy. Although the phosphorus content should preferably be the lowest possible, it is difficult to largely reduce the phosphorus content in an industrial scale from the economic point of view. A phosphorus content of over 0.006 wt. % however deteriorates a hot-workability of the alloy because of the occurrence of the grain boundary brittleness. The phosphorus content should therefore be limited to up to 0.006 wt. %.

(9) Carbon:

Carbon is one of impurities inevitably entrapped into the alloy. Although the carbon content should preferably be the lowest possible, it is difficult to largely reduce the carbon content in an industrial scale from the economic point of view. A carbon content of over 0.003 wt. % however deteriorates a magnetic property of the alloy. The carbon content should therefore be limited to up to 0.003 wt. %, and more preferably, to up to 0.002 wt. %.

(10) Oxygen:

Oxygen is one of impurities inevitably entrapped into the alloy. Although the oxygen content should preferably be the lowest possible, it is difficult to largely reduce the oxygen content in an industrial scale from the economic point of view. An oxygen content of over 0.003 wt. % however causes formation of oxide inclusions in the alloy, leading to a lower hot-workability of the alloy. The oxygen content should therefore be limited to up to 0.003 wt. %, and more preferably, to up to 0.001 wt. %, with a view to reducing the amount of added calcium, as described above.

(11) Nitrogen:

Nitrogen is one of impurities inevitably entrapped into the alloy. Although the nitrogen content should preferably be the lowest possible, it is difficult to largely reduce the nitrogen content in an industrial scale from the economic point of view. With a nitrogen content of over 0.0015 wt. %, however, nitrogen is easily combined with boron in the alloy to form boron nitride (BN), thus reducing the amount of boron in the solid-solution state. In addition, the above-mentioned boron nitride (BN) prevents transfer of the magnetic walls, resulting in a lower magnetic permeability of the alloy. The nitrogen content should therefore be limited to up to 0.0015 wt. %, and more preferably, to up to 0.0010 wt. %.

In the method of the present invention, the alloy material having the above-mentioned chemical composition is heated to a temperature within the range of from 1,100° to 1,250° C., and then, the thus heated alloy material is hot-worked at a finishing temperature of at least 800° C. to manufacture a slab having an excellent surface quality of the ferromagnetic Ni-Fe alloy.

In the method of the present invention, the heating temperature of the alloy material should be limited within the range of from 1,100° to 1,250° C. for the following reason:

The alloy of the present invention No. 5 as shown in Table 1 presented later was melted in a vacuum melting furnace, and then cast into an ingot. Then, test pieces having a diameter of 5 mm and a length of 100 mm were cut from the thus cast ingot. Subsequently, these test pieces were heated to different temperatures, to measure values of reduction of area of the test pieces at the respective heating temperatures. The result is shown in FIG. 6.

Figure 6:
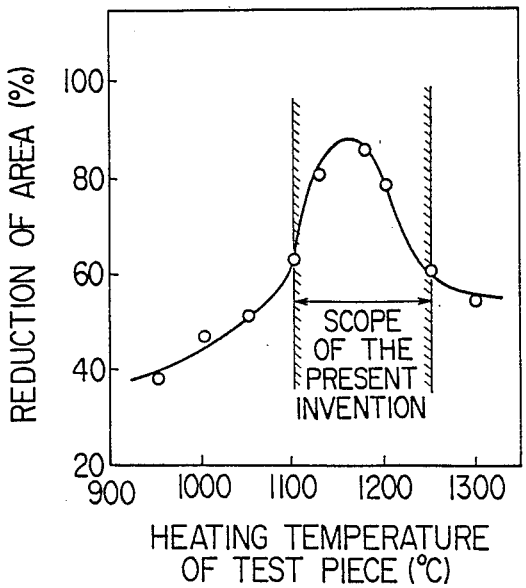
FIG. 6 is a graph illustrating the relationship between the value of reduction of area and the heating temperature of a test piece for an Ni-Fe alloy material.

As is clear from FIG. 6, the values of reduction of area of the test pieces are over 60% which is the target in the present invention, at a heating temperature of the test piece within the range of from 1,100° to 1,250° C. This fact is explained as follows: Until the heating temperature reaches 1,150° C., the value of reduction of area increases under the effect of redissolution of sulfur and phosphorus which have segregated on the grain boundaries. After the heating temperature exceeds 1,150° C., however, the resegregation of the redissolved sulfur and phosphorus on the grain boundaries prevails over the segregation of boron on the grain boundaries, resulting in a lower value of reduction of area. The heating temperature of the alloy material should therefore be limited within the range of from 1,100° to 1,250° C.

In the method of the present invention, the finishing temperature of the alloy material should be limited to at least 800° C. for the following reason:

As is clear from FIG. 1, a tension test temperature of under 800° C. leads to a sharp decrease in the value of reduction of area of the test pieces of the alloy of the present invention No. 7. This is attributable to the strength within the crystal grain being larger than that at the grain boundary, at the temperature of under 800° C. This fact is clear also from FIG. 3. In order to manufacture a slab having an excellent surface quality of the ferromagnetic Ni-Fe alloy, therefore, the alloy material should be hot-worked at a temperature of at least 800° C.

Now, the ferromagnetic Ni-Fe alloy of the present invention is described in more detail by means of examples.

EXAMPLE 1

Ni-Fe alloys each having a chemical composition within the scope of the present invention as shown in Table 1, and Ni-Fe alloys each having a chemical composition outside the scope of the present invention as shown also in Table 1, were melted in a vacuum melting furnace, and then cast into ingots. Subsequently, test pieces having a diameter of 5 mm and a length of 100 mm of the alloy within the scope of the present invention (hereinafter referred to as the "test pieces of the invention") Nos. 1 to 12, and test pieces also having a diameter of 5 mm and a length of 100 mm of the alloy outside the scope of the present invention (hereinafter referred to as the "test pieces for comparison") Nos. 13 to 23, were cut from the respective ingots thus cast. These test pieces were then heated to a temperature of 1,200° C., and then cooled to a temperature within the range of from 800° to 1,000° C., to measure the minimum values of reduction of area of these test pieces within this temperature range. The result is also shown in Table 1.

TABLE 1

| No. | Chemical composition (wt. %) Ni | Mo | Cu | B | Ca | Mn | S | P | C | O | N | Others | Ca/S | Minimum value of reduction of area within temperature range of from 800 to 1,000° C. (%) |
|---|---|---|---|---|---|---|---|---|---|---|---|---|---|---|
| Test piece of the invention | | | | | | | | | | | | | | |
| 1 | 80.50 | 4.30 | — | 0.0025 | 0.0012 | — | 0.0004 | 0.001 | 0.0016 | 0.0015 | 0.0004 | — | 3.00 | 75 |
| 2 | 79.30 | 4.56 | — | 0.0012 | 0.0016 | 0.35 | 0.0010 | 0.003 | 0.0020 | 0.0011 | 0.0005 | — | 1.60 | 80 |
| 3 | 79.39 | 4.65 | — | 0.0046 | 0.0028 | 0.30 | 0.0008 | 0.002 | 0.0009 | 0.0014 | 0.0007 | — | 3.50 | 83 |
| 4 | 80.56 | 4.24 | 2.27 | 0.0040 | 0.0010 | — | 0.0005 | 0.001 | 0.0012 | 0.0014 | 0.0005 | — | 2.00 | 66 |
| 5 | 79.01 | 4.29 | 2.18 | 0.0014 | 0.0022 | 0.38 | 0.0011 | 0.004 | 0.0018 | 0.0013 | 0.0010 | — | 2.00 | 69 |
| 6 | 79.10 | 4.26 | 2.12 | 0.0042 | 0.0046 | 0.35 | 0.0016 | 0.003 | 0.0015 | 0.0011 | 0.0003 | — | 2.70 | 79 |
| 7 | 79.50 | 4.05 | 2.50 | 0.0030 | 0.0030 | 0.36 | 0.0010 | 0.005 | 0.0017 | 0.0012 | 0.0003 | — | 3.00 | 72 |
| 8 | 81.13 | 5.50 | — | 0.0034 | 0.0011 | — | 0.0007 | 0.002 | 0.0014 | 0.0005 | 0.0002 | — | 1.57 | 80 |
| 9 | 80.42 | 4.15 | — | 0.0040 | 0.0013 | 0.38 | 0.0007 | 0.002 | 0.0018 | 0.0008 | 0.0007 | — | 1.86 | 92 |
| 10 | 77.94 | 4.18 | 2.13 | 0.0045 | 0.0010 | — | 0.0004 | 0.003 | 0.0015 | 0.0009 | 0.0006 | — | 2.50 | 70 |
| 11 | 78.32 | 4.03 | 2.27 | 0.0044 | 0.0016 | 0.31 | 0.0013 | 0.001 | 0.0014 | 0.0006 | 0.0006 | — | 1.23 | 75 |
| 12 | 78.88 | 4.12 | 2.27 | 0.0045 | 0.0017 | 0.30 | 0.0011 | 0.001 | 0.0018 | 0.0002 | 0.0004 | — | 1.55 | 90 |
| Test piece for comparison | | | | | | | | | | | | | | |
| 13 | 79.35 | 3.92 | 2.60 | 0.0020 | 0.0038 | 0.35 | 0.0015 | 0.009 | 0.0012 | 0.0005 | 0.0008 | — | 2.53 | 45 |
| 14 | 78.52 | 4.03 | 2.61 | 0.0012 | 0.0059 | 0.30 | 0.0033 | 0.004 | 0.0015 | 0.0005 | 0.0002 | — | 1.79 | 15 |
| 15 | 79.30 | 4.05 | 2.02 | 0.0031 | — | 0.32 | 0.0018 | 0.005 | 0.0052 | 0.0003 | 0.0011 | — | — | 20 |
| 16 | 79.41 | 4.63 | 1.90 | 0.0020 | 0.0012 | 0.30 | 0.0015 | 0.003 | 0.0013 | 0.0012 | 0.0006 | — | 0.80 | 39 |
| 17 | 79.37 | 4.32 | — | 0.0025 | 0.0041 | 0.37 | 0.0009 | 0.004 | 0.0020 | 0.0013 | 0.0013 | — | 4.56 | 31 |
| 18 | 79.96 | 4.27 | 2.20 | — | 0.0027 | 0.32 | 0.0015 | 0.002 | 0.0016 | 0.0004 | 0.0002 | — | 1.80 | 32 |
| 19 | 79.20 | 4.35 | — | 0.0006 | 0.0020 | 0.35 | 0.0010 | 0.004 | 0.0011 | 0.0008 | 0.0006 | — | 2.00 | 39 |
| 20 | 79.08 | 4.30 | 2.23 | 0.0060 | 0.0021 | 0.30 | 0.0007 | 0.003 | 0.0008 | 0.0002 | 0.0011 | — | 3.00 | 9 |
| 21 | 79.00 | 3.88 | 2.76 | 0.0030 | — | 0.35 | 0.0016 | 0.006 | 0.0014 | 0.0007 | 0.0012 | Ti: 0.10 | — | 35 |
| 22 | 79.36 | 4.07 | — | — | — | 0.25 | 0.0015 | 0.006 | 0.0010 | 0.0005 | 0.0007 | — | — | 22 |
| 23 | 78.98 | 3.98 | 2.56 | — | — | 0.30 | 0.0013 | 0.003 | 0.0010 | 0.0003 | 0.0010 | — | — | 19 |

As is clear from Table 1, for all the test pieces of the invention Nos. 1 to 12, the minimum value of reduction of area is well over 60% which is the target in the present invention, suggesting an excellent hot-workability. Comparison of the test pieces of the invention Nos. 12 and 2 demonstrates that, while these test pieces have substantially the same weight ratio of calcium to sulfur, the oxygen content in the test piece of the invention No. 12 is lower than that in the test piece of the invention No. 2, and the minimum value of reduction of area for the test piece of the invention No. 12 is higher than that for the test piece of the invention No. 2. This suggests that it is possible to further improve hotworkability according as the oxygen content is smaller, even with substantially the same weight ratio of calcium to sulfur.

Alloy sheets having a thickness of 0.1 mm were prepared from the alloys of the present invention Nos. 1 to 12 as shown in Table 1, to investigate a DC magnetic property of these alloy sheets. As a result, these alloy sheets showed an initial magnetic permeability, a maximum magnetic permeability, a saturated magnetic flux density and a coercive force substantially equal to those of PC Permalloy.

In contrast, both the test pieces for comparison Nos. 22 and 23 contain neither born nor calcium. The test piece for comparison No. 21 contains titanium in an attempt to improve hotworkability, but does not contain calcium. The test piece for comparison No. 15 does not contain calcium. The test piece for comparison No. 13 has a high phosphorus content outside the scope of the present invention. The test piece for comparison No. 14 has a high sulfur content outside the scope of the present invention. The test piece for comparison No. 16 has a low weight ratio of calcium to sulfur outside the scope of the present invention. The test piece for comparison No. 17 has a high weight ratio of calcium to sulfur outside the scope of the present invention. The test piece for comparison No. 18 does not contain boron. The test piece for comparison No. 19 has a low boron content outside the scope of the present invention. The test piece for comparison No. 20 has a high boron content outside the scope of the present invention. Consequently, for all the test pieces for comparison Nos. 13 to 23, the minimum value of reduction of area is largely under 60% which is the target in the present invention.

EXAMPLE 2

Ni-Fe alloys having the chemical composition within the scope of the present invention as shown in Table 2, and Ni-Fe alloys having the chemical composition outside the scope of the present invention as shown also in Table 2, were melted in a vacuum melting furnace, and then cast into ingots. Subsequently, the resultant ingots were heated to different temperatures as shown in Table 2, and then subjected to the slabbing at a finishing temperatures also shown in Table 2, to manufacture slabs of the alloy within the scope of the present invention (hereinafter referred to as the "slabs of the invention) Nos. 1 and 2, and slabs of the alloy outside the scope of the present invention (hereinafter referred to as the "slabs for comparison") Nos. 3 to 6. Surface flaws on the thus manufactured slabs were investigated. The result is shown also in Table 2.

The surface flaws on the slabs were investigated as follows: Because the surface flaws on a slab tend to occur at the slab edge as a result of the stress distribution during the slabbing, the surface flaws at the slab edge were investigated. Quantitative determination of the surface flaws at the slab edge was accomplished by totalling the lengths of cracks, having a depth of over 2 mm, produced on a unit sectional area of the slab edge in a transverse direction of the slab. When the slab of an Ni-Fe alloy is heated to a temperature of over 1,100° C., the grain boundary oxidation occurs, and this grain boundary oxidation becomes more remarkable along with the increase in the heating temperature. However, the grain boundary oxidation hardly occurs when using an oxidation preventive agent and lowering the heating temperature to up to 1,250° C. In this example, therefore, the surface flaws caused by the grain boundary oxidation were almost negligible since the oxidation preventive agent was used and the ingots were heated to a temperature of up to 1,250° C., in view of the fact as described above.

TABLE 2

| No. | Chemical composition (wt. %) Ni | Mo | Cu | B | Ca | Mn | S | P | C | O | N | Ca/S | Heating temp. (°C.) | Finishing temp. (°C.) | Surface flaw (cm/cm²) |
|---|---|---|---|---|---|---|---|---|---|---|---|---|---|---|---|
| Slab of the invention | | | | | | | | | | | | | | | |
| 1 | 78.50 | 3.90 | 2.50 | 0.0014 | 0.0028 | 0.40 | 0.0012 | 0.002 | 0.0013 | 0.0014 | 0.0005 | 2.3 | 1,230 | 880 | 0.02 |
| 2 | 78.88 | 4.12 | 2.27 | 0.0045 | 0.0017 | 0.30 | 0.0011 | 0.001 | 0.0018 | 0.0002 | 0.0004 | 1.6 | 1,200 | 900 | 0.005 |
| Slab for comparison | | | | | | | | | | | | | | | |
| 3 | 78.35 | 4.00 | 2.60 | 0.0025 | 0.0019 | 0.35 | 0.0009 | 0.003 | 0.0010 | 0.0007 | 0.0007 | 2.1 | 1,300 | 920 | 2.00 |
| 4 | 79.55 | 4.20 | — | 0.0020 | 0.0019 | 0.35 | 0.0010 | 0.003 | 0.0011 | 0.0003 | 0.0010 | 1.9 | 1,180 | 750 | 3.50 |
| 5 | 78.60 | 4.02 | 2.10 | 0.0025 | 0.0010 | 0.37 | 0.0018 | 0.005 | 0.0015 | 0.0013 | 0.0008 | 0.6 | 1,230 | 880 | 3.80 |
| 6 | 79.01 | 3.80 | 2.70 | 0.0005 | 0.0033 | 0.25 | 0.0013 | 0.005 | 0.0009 | 0.0005 | 0.0003 | 2.5 | 1,240 | 890 | 3.46 |

As is clear from Table 2, all the slabs of the invention Nos. 1 and 2 have only a few surface flaws.

In contrast, the slab for comparison No. 3 has a high heating temperature of the ingot outside the scope of the present invention, although the chemical composition thereof is within the scope of the present invention. The slab for comparison No. 4 has a low finishing temperature of the slab outside the scope of the present invention, although the chemical composition thereof is within the scope of the present invention. The slab for comparison No. 5 has a low weight ratio of calcium to sulfur outside the scope of the present invention, although the heating temperature of the ingot and the finishing temperature of the slab are within the scope of the present invention. The slab for comparison No. 6 has a low boron content outside the scope of the present invention, although the heating temperature of the ingot and the finishing temperature of the slab are within the scope of the present invention. As a result the slabs for comparison Nos. 3 to 6 have far more surface flaws than the slabs of the invention Nos. 1 and 2.

Slabs were manufactured from the alloys of the present invention Nos. 1 to 12 shown in Table 1 in accordance with the methods of the present invention, and surface flaws on these slabs were investigated in the same manner as in Example 2. The result shows that all the slabs have only a few surface flaws.

As is clear from the above-mentioned Example 2, according to the method of the present invention, it is possible to manufacture a slab having an excellent surface quality. Furthermore, by heating the above-mentioned slab to a temperature within the range of from 1,100° to 1,250° C., and then hot-rolling the slab thus heated at a finishing temperature of at least 800° C., it is possible to manufacture a ferromagnetic Ni-Fe alloy sheet having an excellent surface quality. In addition by heating the abovementioned alloy sheet to a temperature within the range of from 1,100° to 1,250° C., and then hot-pressing the thus heated alloy sheet at a finishing temperature of at least 800° C., it is possible to manufacture a press-formed article having an excellent surface quality.

According to the present invention, as described above in detail, it is possible to manufacture a ferromagnetic Ni-Fe alloy having an excellent hot-workability, and an alloy article having an excellent surface quality of the above-mentioned alloy, thus providing industrially useful effects.

What is claimed is:

1. A ferromagnetic Ni-Fe alloy consisting essentially of:

| | |
|---|---|
| nickel | from 75 to 82 wt. %, |
| molybdenum | from 2 to 6 wt. %, |
| boron | from 0.001 to 0.005 wt. %, |
| calcium | within the range satisfying the following formula in a weight ratio to sulfur as an incidental impurity, in the case of an oxygen content as an incidental impurity being within the range of from over 0.001 to 0.003 wt. %: $1.5 \leqq Ca/S \leqq 3.5 \ldots (1)$, or within the range satisfying the following formula in a weight ratio to sulfur as an incidental impurity, in the case of an oxygen content as an incidental impurity being up to 0.001 wt. %: $1.15 \leqq Ca/S \leqq 3.50 \ldots (2)$, |

and the balance being iron and incidental impurities, where, the respective contents of sulfur, phosphorus, carbon, oxygen and nitrogen as said incidental impurities being:

up to 0.002 wt. % for sulfur,
up to 0.006 wt. % for phosphorus,
up to 0.003 wt. % for carbon,
up to 0.003 wt. % for oxygen, and
up to 0.0015 wt. % for nitrogen.

2. The Ni-Fe alloy as claimed in claim 1, wherein: said Ni-Fe alloy additionally contains copper in an amount within the range of from 1 to 5 wt. %.

3. The Ni-Fe alloys as claimed in claim 1, wherein: said Ni-Fe alloy additionally contains manganese in an amount within the range of from 0.1 to 0.4 wt. %.

4. The Ni-Fe alloy as claimed in claim 2, wherein: said Ni-Fe alloy additionally contains manganese in an amount within the range of from 0.1 to 0.4 wt. %.

5. A method for manufacturing an alloy article having an excellent surface quality of a ferromagnetic Ni-Fe alloy, comprising the steps of: nickel: from 75 to 82 wt.%, molybdenum: from 2 to 6 wt.%, boron: from 0.001 to 0.005 wt.%, calcium: within the range satisfying the following formula in a weight ratio to sulfur as an incidental impurity, in the case of an oxygen content as an incidental impurity being within the range of from over 0.001 to 0.003 wt. %;

$$1.5 \leqq Ca/S \leqq 3.5 \ldots \quad (1)$$

or within the range satisfying the following formula in a weight ratio sulfur as an incidental impurity, in the case of an oxygen content as an incidental impurity being up to 0.001 wt. %:

$$1.15 \leqq Ca/S \leqq 3.50 \ldots \quad (2),$$

and the balance being iron and incidental impurities, where, the respective contents of sulfur, phosphorus, carbon, oxygen and nitrogen as said incidental impurities being:

up to 0.002 wt. % for sulfur,
up to 0.006 wt. % for phosphorus,
up to 0.003 wt. % for carbon,
up to 0.003 wt. % for oxygen, and
up to 0.0015 wt. % for nitrogen;

heating said material to a temperature within the range of from 1,100° to 1,250° C.; and then hot-working said material thus heated at a finishing temperature of at least 800° C. to manufacture an alloy article having an excellent surface quality of a ferromagnetic Ni-Fe alloy.

6. The method as claimed in claim 5, wherein: said material further additionally contains copper in an amount within the range of from 1 to 5 wt. %.

7. The method as claimed in claim 5, wherein: said material additionally contains manganese in an amount within the range of from 0.1 to 0.4 wt. %.

8. The method as claimed in claim 6, wherein: said material additionally contains manganese in an amount within the range of from 0.1 to 0.4 wt. %.

9. The method as claimed in claim 5, wherein said alloy article is a slab.

10. The method as claimed in claim 5, wherein said alloy article is a strip.

11. The method as claimed in claim 9, wherein: said material additionally contains copper in an amount within the range of from 1 to 5 wt. %.

12. The method as claimed in claim 10, wherein: said material additionally contains copper in an amount within the range of from 1 to 5 wt. %.

13. The method as claimed in claim 9, wherein: said material additionally contains manganese in an amount within the range of from 0.1 to 0.4 wt. %.

14. The method as claimed in claim 10, wherein: said material additionally contains manganese in an amount within the range of from 0.1 to 0.4 wt. %.

* * * * *

UNITED STATES PATENT AND TRADEMARK OFFICE

CERTIFICATE OF CORRECTION

PATENT NO. : 4,935,201

DATED : June 19, 1990

INVENTOR(S) : INOUE et al

It is certified that error appears in the above-identified patent and that said Letters Patent is hereby corrected as shown below:

Column 15, line 48 (Claim 5, line 3):

After "the steps of:", insert --providing a material consisting essentially of:--;

Column 16, line 29 (Claim 6, line 2):

Delete "further".

Signed and Sealed this

Seventeenth Day of March, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,935,201

DATED : June 19, 1990

INVENTOR(S) : Inoue, et al

It is certified that error appears in the above-indentified patent and that said Letters Patent is hereby corrected as shown below:

Column 16, line 7, after "ratio" insert --to--.

Signed and Sealed this

Second Day of August, 1994

*Attest:*

*Attesting Officer*

BRUCE LEHMAN

*Commissioner of Patents and Trademarks*